US005780812A

United States Patent [19]

Klinkenberg

[11] Patent Number: 5,780,812

[45] Date of Patent: Jul. 14, 1998

[54] LAMP HEATED IRON WITH TEMPERATURE CONTROL MEANS

[75] Inventor: Klaus Klinkenberg, Aachen, Germany

[73] Assignee: U.S. Philips Corporation, New York, N.Y.

[21] Appl. No.: 754,834

[22] Filed: Nov. 22, 1996

Related U.S. Application Data

[63] Continuation of Ser. No. 280,918, Jul. 27, 1994, abandoned.

[30] Foreign Application Priority Data

Jul. 29, 1993 [DE] Germany ..... 43 25 453.5

[51] Int. Cl.[6] ..... D06F 75/24; H05B 3/74

[52] U.S. Cl. ..... 219/251; 219/255; 38/82; 38/77.6

[58] Field of Search ..... 219/255–257, 219/245, 259, 250–252; 38/77.1–77.9, 81, 82

[56] References Cited

U.S. PATENT DOCUMENTS

| | | | |
|---|---|---|---|
| 3,098,922 | 7/1963 | Paxton . | |
| 3,789,853 | 2/1974 | Reinhard | 392/411 |
| 5,042,179 | 8/1991 | van der Meer | 38/77.83 |

FOREIGN PATENT DOCUMENTS

| | | | |
|---|---|---|---|
| 3541424 | 5/1987 | Germany . | |
| 60-31800 | 2/1985 | Japan | 219/251 |
| 61-228513 | 10/1986 | Japan | 219/252 |
| 3-77592 | 4/1991 | Japan | 219/252 |
| 4-132599 | 5/1992 | Japan . | |
| 4-180799 | 6/1992 | Japan . | |
| 4-319397 | 11/1992 | Japan | 219/251 |
| 4-354982 | 12/1992 | Japan | 219/251 |
| 5-23498 | 2/1993 | Japan . | |
| 5-84400 | 4/1993 | Japan . | |
| 5-228298 | 9/1993 | Japan | 219/252 |
| 5-305199 | 11/1993 | Japan | 219/252 |
| 1144251 | 3/1969 | United Kingdom | 219/250 |

*Primary Examiner*—John A. Jeffery
*Attorney, Agent, or Firm*—Ernestine C. Bartlett

[57] ABSTRACT

An electric smoothing iron is provided which has a soleplate (3) which has a low heat capacity and which is heatable by means of light energy produced by lamps (6), reflectors (7) being provided to reflect the light to the soleplate (3), and the temperature of the soleplate (3) being monitored by means of a sensor, which iron comprises a microprocessor (13) which receives the measurement values from the sensor (12) and compares said measurement values with presettable nominal values of a temperature control device (14), which microprocessor is connected to a power control unit (15) which acts as a half-wave control and operates the lamps separately, in series or in parallel.

27 Claims, 5 Drawing Sheets

LAMP HEATED IRON WITH TEMPERATURE CONTROL MEANS

This is a continuation of application Ser. No. 08/280,918, filed Jul. 27, 1994, now abandoned.

FIELD OF THE INVENTION

The invention relates to an electric smoothing iron comprising a soleplate which has a low heat capacity and which is heatable by means of light energy produced by lamps, reflectors being provided to reflect the light to the soleplate, and the temperature of the soleplate being monitored by means of a sensor.

BACKGROUND OF THE INVENTION

Such a smoothing iron is known from U.S. Pat. No. 3,098,922. An elongated lamp disposed above the soleplate radiates its light onto the soleplate. All the light emitted by the lamp is reflected to the soleplate by means of a reflector.

A sensor is arranged at the location of the light-weight soleplate to detect the temperature of the soleplate. The sensor influences a power switch, which turns the lamp on and off.

DE 35 41 424 A1 describes another smoothing iron which uses a lamp to heat the soleplate but which is constructed as a steam iron. The water is heated by the heat radiated by the lamp and evaporates.

The prior-art light-heated smoothing irons are controlled in conventional manner, which is not sensitive enough. The advantage of light-heating in principle resides in the fact that the heat supply ceases immediately when the light is turned off. This advantage, which can be utilized for example to preclude damage to the fabric when the iron is at rest for a longer time, is not used effectively in the known control mechanisms.

SUMMARY OF THE INVENTION

An object of the invention is to provide a smoothing iron of the type defined in the opening paragraph, in which the heat supply to the soleplate is controlled very accurately.

According to the invention this object is achieved through use of a microprocessor which receives the measurement values from the sensor and compares said measurement values with presettable nominal values of a temperature control device, which microprocessor is connected to a power control unit which acts as a half-wave control and operates the lamps separately, in series or in parallel, in accordance with the current power requirement.

With such an arrangement of the lamps inside the iron it is possible to bring the soleplate up to the selected temperature in a minimal time without any overshoot in the case of compliance with all the mains standards. The advantage now resides in a very rapid availability.

In a further embodiment of the invention the heat capacity of the soleplate is approximately 0.5 to $1.5\times10^{-4}$ Wh/Kcm$^2$. A soleplate having such a low heat capacity is very suitable for temperature control by means of a microprocessor.

The combination of a low heat capacity with accurate and fast microprocessor control makes it possible to determine by means of software whether power is needed (ironing takes place) or whether the iron is at rest, i.e. should be turned off, the low heat capacity enabling the temperature to be lowered rapidly to a standby temperature which is safe for the fabric or to be turned off completely after a time which is predetermined by the microprocessor, thus allowing the iron to be left standing on the fabric in its turned-on condition without damage to the fabric.

In a further embodiment of the invention a transparent partition is disposed inside the housing of the iron spaced from the inner side of the soleplate between the lamps and the soleplate, between which partition and the soleplate a steam chamber is formed into which water or steam can be fed. Thus, the steam is kept available directly above the soleplate and is heated, evaporated and re-heated over a large area at the walls and by self-absorption of the water. These effects are promoted by an absorbing inner side of the soleplate and the transparent cover. In a further embodiment of the invention the partition consists of borosilicate glass or a glass-ceramic.

In a further embodiment of the invention the microprocessor has a timing element which at given time intervals checks whether the nominal temperature of the soleplate has changed relative to its actual temperature and is responsive to a difference between the nominal and the actual temperature to control the temperature of the soleplate to the new nominal temperature by increasing or reducing the light power. This results in a very accurate temperature control.

In a further embodiment of the invention the steam is applied from a separate water heating device. This enables far more steam to be supplied and used for ironing.

BRIEF DESCRIPTION OF THE DRAWINGS

The invention will now be described in more detail, by way of example, with reference to the drawings. In the drawings.

DETAILED DESCRIPTION OF THE PREFERRED EMBODIMENTS

The low-capacity smoothing iron comprises a housing 1, which is closed by a soleplate 2 at the bottom. The soleplate has a low heat capacity and is of very thin cross-section, which has become possible by the use of reinforcement ribs 3. The thickness of the soleplate 2 is, for example, 1 mm.

Figure 1:
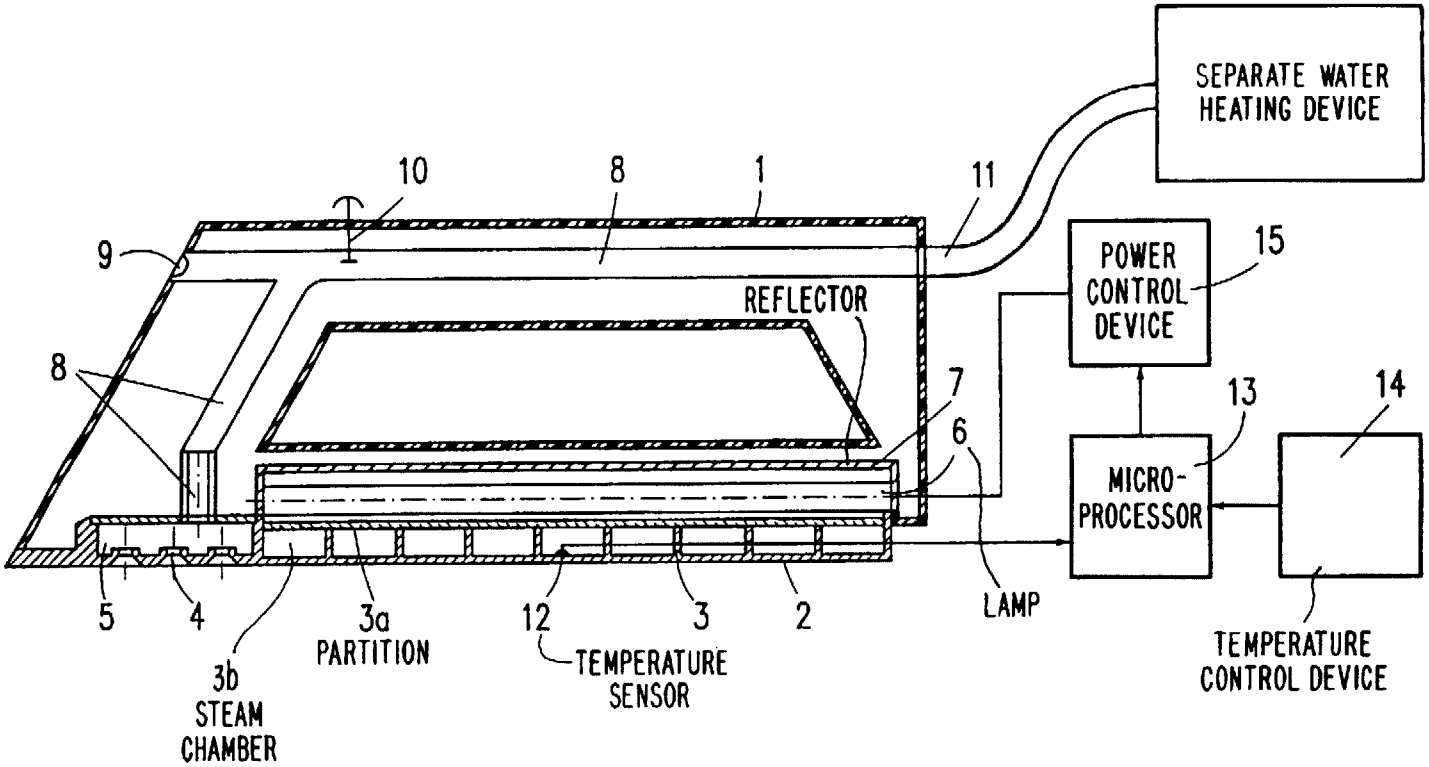
FIG. 1 is a longitudinal sectional view showing a steam iron in accordance with the invention.
Figure 2:
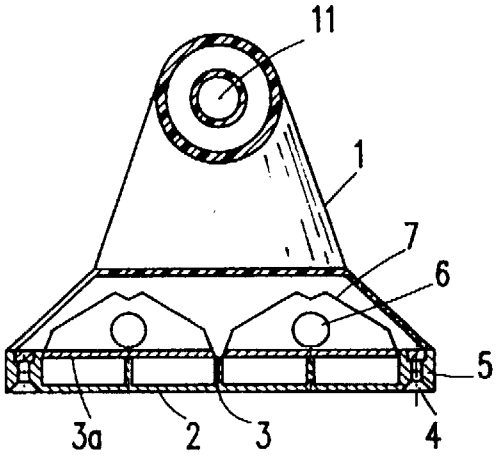
FIG. 2 is a cross-sectional view of the steam iron shown in FIG. 1.
Figure 3:
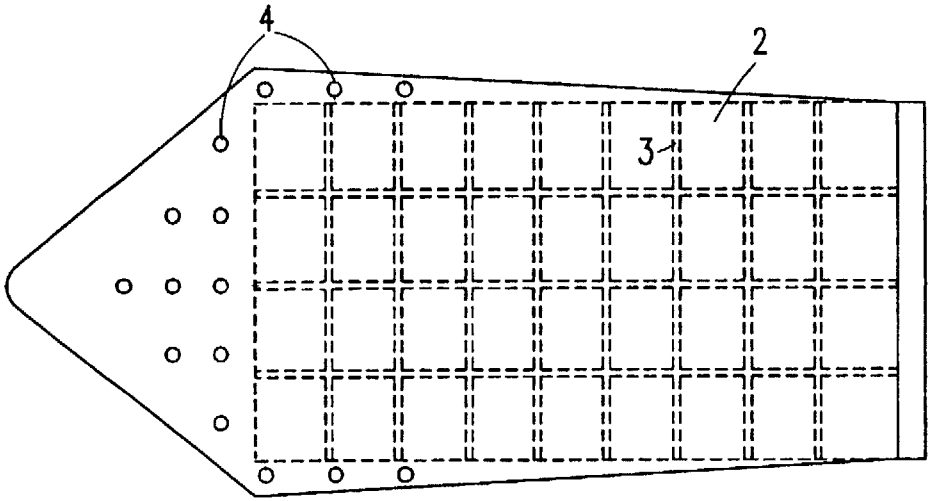
FIG. 3 shows the steam iron viewed at the ironing surface of the soleplate.

Above the reinforcement ribs 3 the soleplate 2 is covered by a partition 3*a* of a glass-ceramic or borosilicate, so that a cavity 3*b* is formed which serves as steam or evaporation chamber, particularly if the water is evaporated in the iron itself. The water supply for the present construction is shown as numeral 112 in FIG. 1.

The soleplate 2 has steam ports 4 situated at the location of a steam compartment 5, which is supplied, in a manner not shown, from the steam or evaporation chamber 3b. The steam ports may also be situated in the soleplate in the direct radiation field of the lamps and reflector.

The present embodiment has a steam pipe 8 leading to the steam compartment 5 and to a steam nozzle 9. The steam pipe 8 can be shut off by means of a valve 10. In the present embodiment the steam is supplied to the iron from a separate steam generator via a duct 11.

Two halogen lamps 6 extend parallel to the plane of the soleplate 2 and reflectors 7 arranged above them serve to project all the light emitted by the halogen lamps onto the soleplate 2. The reflectors 7 consist of aluminum.

Figure 9:
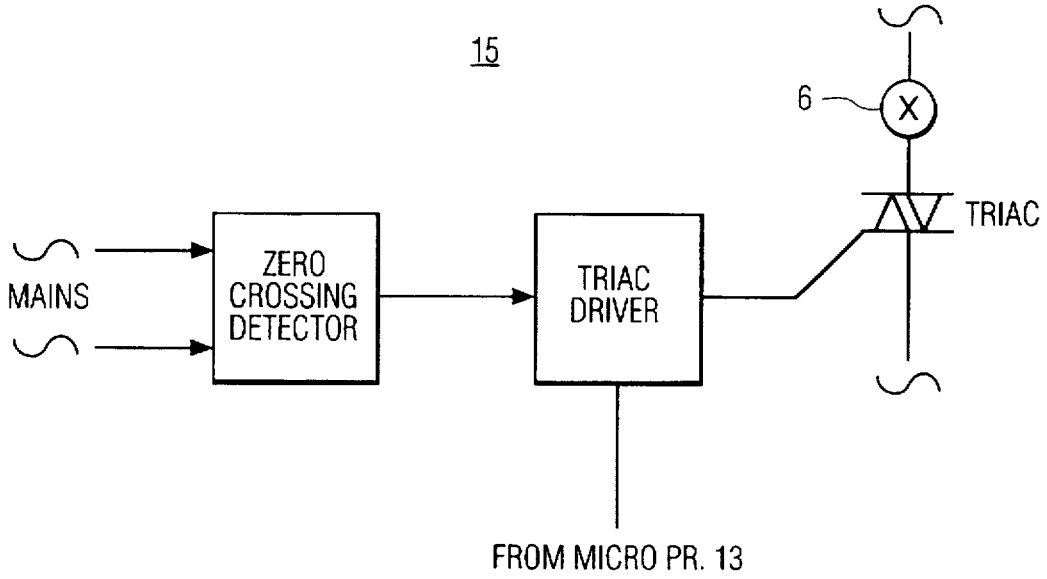
FIG. 9 shows a schematic of the power control unit 15 acting as a half-wave control.

On the soleplate, which is absorbent at its inner side, a temperature sensor 12 is arranged to detect the temperature of the soleplate. The sensor 12 is connected to a microprocessor 13, which is associated with a temperature control device 14. The microprocessor compares the actual temperature measured by the sensor 12 with the nominal temperature, which is preset by means of the manually controlled temperature control device 14. A power control device 15 acts as a half-wave control and receives control commands from the microprocessor 13 to turn on and turn off the lamps 6. For example, as illustrated in FIG. 9, a switch or triac in series with the lamp 6 is conductive for half-waves of the mains voltage. The average power of the lamp is controlled by changing the ratio of the number of half-waves during which the lamp is switched ON and the number of half-waves during which the lamp is switched OFF. The triac receives trigger pulses from a triac driver. The trigger pulses are synchronized with the zero crossings of the mains voltage so that triggering occurs at the beginning of a half-wave of the mains voltage. The triac driver also receives a drive signal from the microprocessor 13, which drive signal determines whether the next half-wave of the mains voltage is to be used or not. Triac drivers and triacs and the use thereof for control of half-waves are well known in the art.

The user sets the temperature control device to the temperature required for the relevant ironing process, i.e. required for the fabric to be ironed. This is the temperature δ0 in FIG. 4. In the temperature-time diagram shown in FIG. 4 the relevant soleplate temperatures are plotted versus the operating times. The time interval t0 to t1 represents the beginning of the heating process of the smoothing iron. At this instant, after a soft start with half-wave control, the power supply is switched to the full power P0 in the diagram shown in FIG. 5. In this diagram the power used for heating is plotted versus the time axis corresponding to FIG. 4. The lamps 6 are operated separately, in series or in parallel.

The power control initially ensures that the soleplate is heated to the temperature δ0. At this instant the soleplate is, for example, not loaded and does not deliver any heat. Therefore, the power is reduced to the no-load power P1 which allows for the no-load losses. The ironing process starts at the instant t1, for which again the power P0 is applied, which is reduced to P1 as the dryness of the fabric increases. From the instant t2 the iron stands on the dry fabric without being moved and subsequently the temperature δ1 is exceeded towards δ0.

Figure 4:
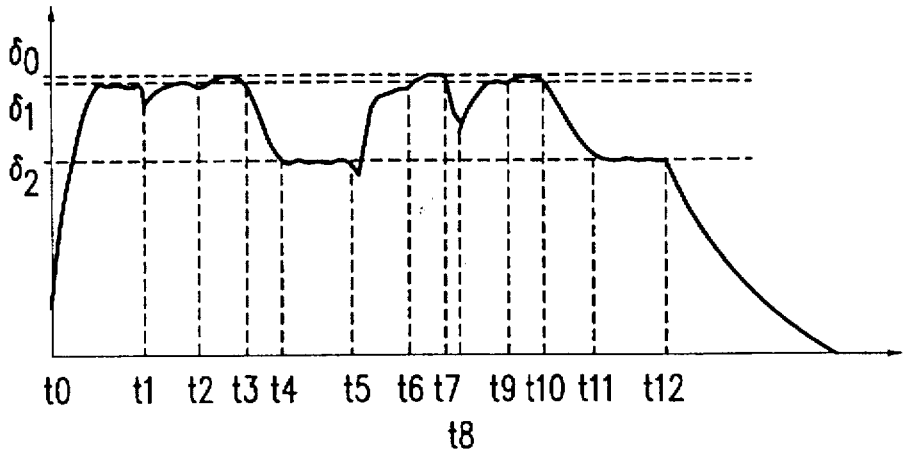
FIG. 4 is a time-temperature diagram of the iron control system.
Figure 5:
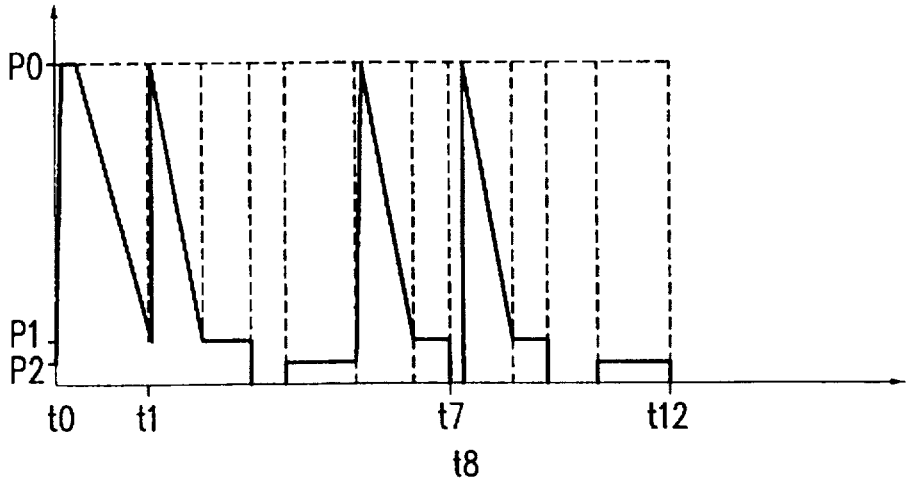
FIG. 5 is a time-power diagram of the iron-control system in accordance with FIG. 4.
Figure 6:
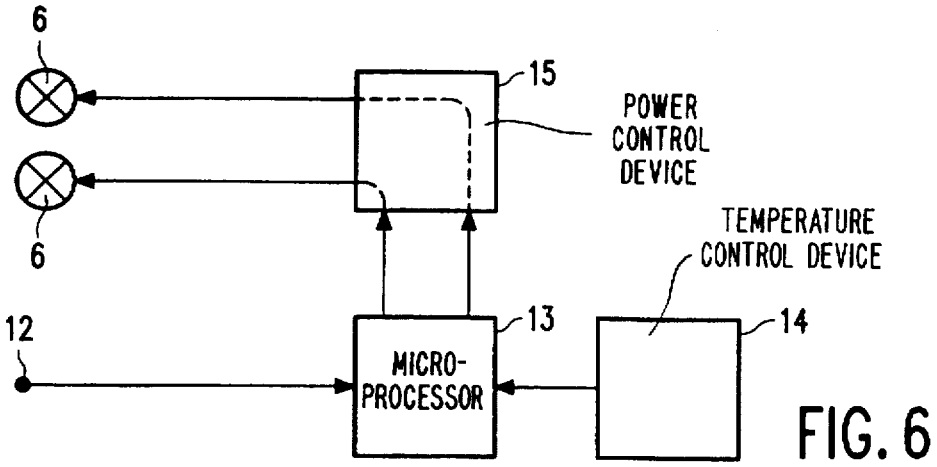
FIG. 6 shows a schematic of the control operation of the lamps separately.
Figure 7:
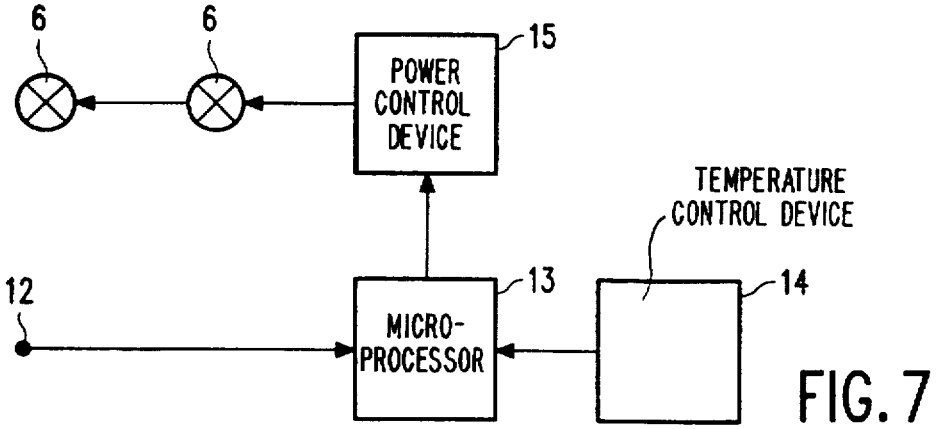
FIG. 7 shows a schematic of the control operation of the lamps in series.
Figure 8:
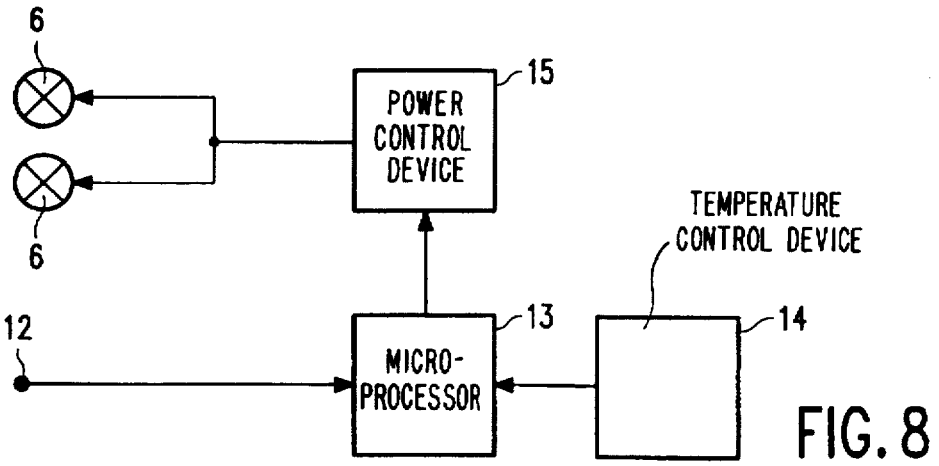
FIG. 8 shows a schematic of the control operation of the lamps in parallel.

If after a time t3 minus t2 the microprocessor 13 detects that the temperature has not fallen below the temperature δ1, it will interpret this as resting and will reduce the nominal temperature from δ0 to the standby temperature δ2. This means that the power control unit sets the power to P=0 until δ2 is reached. The temperature δ2 is maintained with a reduced power P2 until ironing begins again. In FIG. 4 ironing begins at t5.

If during the time that the iron falls from δ0 to δ2 (P=0; no power supply) it is moved for ironing (at the instant t8) this will be detected by the microprocessor as a result of a sudden power requirement. For this purpose the gradient is always computed from the last four temperature values and is compared at least with that of the preceding measurement cycle.

After the power has been turned off (rest condition) the curve representing the fall of the iron temperature will become increasingly flatter as a result of the thermal conditions. The soleplate temperature, which is measured at fixed time intervals, is written into a memory, which always stores the last four values in time sequence. From this the actual gradient (temperature fall as function of time)is calculated and is also written into a memory. After the next measurement cycle the old measurement values are shifted in the memory, i.e. the oldest value is replaced by the oldest but one (etc.) and the actual gradient is computed using the most recent actual value and is compared with the gradient in the memory. Taking into account the accuracy of the temperature measurement a gradient change of, for example, 20% will be a reliable indication that ironing has been re-started, so that in this case the microprocessor switches from the stand-by temperature to the old nominal temperature.

Owing to the low heat capacity of the soleplate the temperature rise per 1000 W rated power is approximately 7 K/s. This means that a cycle time of approximately 0.4 to 0.5 s is required. This cycle time can be determined with the following control parameters. With a loop gain of Rv=60 W/K and a rate time Tv=1.2 s it is possible to realize an effective control between the temperature values δ0 and δ0–0.36×(δ0–20).

This rate time is valid only in the limited range below the nominal temperature up to a temperature corresponding to 64% of the nominal temperature minus 7.2 K (ambient temperature correction). Outside this range the controller operates purely proportionally to the deviation.

The heat capacity of the soleplate should be only approximately 0.5 to $1.5\times10^{-4}$ Wh/Kcm$^2$ as compared with approximately $6\times10^{-4}$ Wh/Kcm$^2$ for a conventional soleplate.

I claim:

1. An electric iron comprising a soleplate (2) which has a low heat capacity and which is heatable by means of light energy produced by a plurality of lamps (6), reflectors (7) provided to reflect the light to the soleplate (2), a sensor (12) which monitors the temperature of the soleplate (2), and a microprocessor (13) which receives measurement values from the sensor (12) and compares said measurement values with presettable nominal values of a temperature control device (14), said microprocessor being connected to a power control unit (15) which acts as a half-wave control of the mains voltage by controlling the number of half-waves during which the lamps are ON and the number of half-waves during which the lamps are OFF and operates the lamps in accordance with the current power requirement, wherein responsive to the difference between the actual temperature and the nominal temperature remaining uninterruptedly below a predetermined value for a predetermined duration, the microprocessor identifies a condition of rest of the iron and switches back to a lower standby temperature which is safe for the fabric to be ironed, and wherein after identification of the rest condition the microprocessor stores and measures the soleplate temperature, computes a gradient therefrom and compares it with a preceding computed gradient, identifies predetermined changes as the start of the ironing process and switches to the previous nominal temperature.

2. An electric iron as claimed in claim 1, wherein the heat capacity of the soleplate (2) is approximately 0.5 to $1.5\times10^{-4}$ $Wh/Kcm^2$.

3. An electric iron as claimed in claim 2 wherein the microprocessor (13) has a timing element which at a given time intervals checks whether the nominal temperature of the soleplate (3) has changed relative to its actual temperature and is responsive to a difference between the nominal and the actual temperature to control the temperature of the soleplate to the new nominal temperature by increasing or reducing the light power.

4. An electric iron as claimed in claim 1 wherein responsive to the difference between the actual temperature and the nominal temperature remains uninterruptedly below, about, 1 K for a duration of about twelve measurement cycles the microprocessor identifies this as a condition of rest of the iron and switches back to a lower standby temperature which is safe for the fabric to be ironed.

5. An electric iron as claimed in claim 4 wherein the microprocessor (13) has a timing element which at a given time intervals checks whether the nominal temperature of the soleplate (3) has changed relative to its actual temperature and is responsive to a difference between the nominal and the actual temperature to control the temperature of the soleplate to the new nominal temperature by increasing or reducing the light power.

6. An electric smoothing iron as claimed in claim 1 wherein in that the microprocessor (13) has a timing element which at given time intervals checks whether the nominal temperature of the soleplate (2) has changed relative to its actual temperature and is responsive to a difference between the nominal and the actual temperature to control the temperature of the soleplate to the new nominal temperature by increasing or reducing the light power.

7. An electric iron as claimed in claim 1, wherein the lamps are operated separately.

8. An electric iron as claimed in claim 1, wherein the lamps are operated in series.

9. An electric iron as claimed in claim 1, wherein the lamps are operated in parallel.

10. An electric iron comprising a soleplate (2) which has a low heat capacity and which is heatable by means of light energy produced by a plurality of lamps (6), reflectors (7) being provided to reflect the light to the soleplate (2), and the temperature of the soleplate (2) being monitored by means of a sensor (12), and a microprocessor (13) which receives the measurement values from the sensor (12) and compares said measurement values with presettable nominal values of a temperature control device (14), said microprocessor being connected to a power control unit (15) which acts as a half-wave control of the mains voltage by controlling the number of half-waves during which the lamps are ON and the number of half-waves during which the lamps are OFF and operates the lamps in accordance with the current power requirement, wherein a transparent partition (3*a*) is disposed inside the housing (1) of the irons spaced from the inner side of the soleplate (2) between the lamps (6) and the soleplate (2), between which partition and the soleplate (2) a steam chamber (3*b*) is formed into which water or steam can be fed.

11. An electric iron as claimed in claim 10 wherein the partition consists of a glass-ceramic or borosilicate glass.

12. An electric iron as claimed in claim 11 wherein steam ports in the soleplate are disposed in the direct radiation field of the lamps and reflectors.

13. An electric iron as claimed in claim 11 wherein the microprocessor (13) has a timing element which at a given time intervals checks whether the nominal temperature of the soleplate (2) has changed relative to its actual temperature and is responsive to a difference between the nominal and the actual temperature to control the temperature of the soleplate to the new nominal temperature by increasing or reducing the light power.

14. An electric iron as claimed in claim 10 wherein the inner side of the soleplate has a heat-absorbing surface.

15. An electric iron as claimed in claim 14 wherein the microprocessor (13) has a timing element which at a given time intervals checks whether the nominal temperature of the soleplate (2) has changed relative to its actual temperature and is responsive to a difference between the nominal and the actual temperature to control the temperature of the soleplate to the new nominal temperature by increasing or reducing the light power.

16. An electric iron as claimed in claim 10 wherein the steam is applied from a separate water heating device.

17. An electric iron as claimed in claim 26 wherein the microprocessor (13) has a timing element which at a given time intervals checks whether the nominal temperature of the soleplate (2) has changed relative to its actual temperature and is responsive to a difference between the nominal and the actual temperature to control the temperature of the soleplate to the new nominal temperature by increasing or reducing the light power.

18. An electric iron as claimed in claim 10 wherein the lamps are operated separately.

19. An electric iron as claimed in claim 10 wherein the lamps are operated in series.

20. An electric iron as claimed in claim 10 wherein the lamps are operated in parallel.

21. An electric iron comprising a soleplate (2) which has a heat capacity of approximately 0.5 to $1.5\times10^{-4}$ $Wh/Kcm^2$ and which is heatable by means of light energy produced by a plurality of lamps (6), reflectors (7) being provided to reflect the light to the soleplate (2), and the temperature of the soleplate (2) being monitored by means of a sensor (12), and a microprocessor (13) which receives the measurement values from the sensor (12) and compares said measurement values with presettable nominal values of a temperature control device (14), said microprocessor being connected to a power control unit (15) which acts as a half-wave control of the mains voltage by controlling the number of half-waves during which the lamps are ON and the number of half-waves during which the lamps are OFF and operates the lamps in accordance with the current power requirement, wherein a transparent partition (3*a*) is disposed inside the housing (1) of the irons spaced from the inner side of the soleplate (2) between the lamps (6) and the soleplate (2), between which partition and the soleplate (2) a steam chamber (3*b*) is formed into which water or steam can be fed.

22. An electric iron as claimed in claim 21 wherein the partition consists of a glass-ceramic or borosilicate glass.

23. An electric iron as claimed in claim 21 wherein the lamps are operated separately.

24. An electric iron as claimed in claim 21 wherein the lamps are operated in series.

25. An electric iron as claimed in claim 21 wherein the lamps are operated in parallel.

26. An electric iron comprising a soleplate (2) which has a low heat capacity and which is heatable by means of light energy produced by a plurality of lamps (6), reflectors (7)

provided to reflect the light to the soleplate (2), a sensor (12) which monitors the temperature of the soleplate (2) and a microprocessor (13) which receives the measurement values from the sensor (12) and compares said measurement values with presettable nominal values of a temperature control device (14), said microprocessor being connected to a power control unit (15) which acts as a half-wave control of the mains voltage by controlling the number of half-waves during which the lamps are ON and the number of half-waves during which the lamps are OFF and operates the lamps in accordance with the current power requirement, wherein responsive to the difference between the actual temperature and the nominal temperature remaining uninterruptedly below about 1K for a duration of about twelve measuring cycles, the microprocessor identifies a condition of rest of the iron and switches back to a lower standby temperature which is safe for the fabric to be ironed, and wherein after identification of the rest condition the microprocessor (13) stores and continually updates the soleplate temperature, computes a gradient therefrom, stores said gradient and compares it with a preceding computed gradient, identifies distinct changes as the start of the ironing process and switches to the previous nominal temperature.

27. An electric iron as claimed in claim 26 wherein the microprocessor (13) has a timing element which at a given time intervals checks whether the nominal temperature of the soleplate (3) has changed relative to its actual temperature and is responsive to a difference between the nominal and the actual temperature to control the temperature of the soleplate to the new nominal temperature by increasing or reducing the light power.

* * * * *